US005511891A

United States Patent [19]

Nehowig et al.

[11] Patent Number: 5,511,891

[45] Date of Patent: Apr. 30, 1996

[54] TAPE PRINTING MACHINE WITH IR SENSING

[75] Inventors: Kelly R. Nehowig; David T. Gale, both of Maple Grove; Scott W. Kullman, Plymouth; Brynn D. Rogers, Brooklyn Center, all of Minn.

[73] Assignee: Varitronic Systems, Inc., Minneapolis, Minn.

[21] Appl. No.: 259,668

[22] Filed: Jun. 14, 1994

[51] Int. Cl.[6] ..... B41J 11/42

[52] U.S. Cl. ..... 400/583; 400/627; 400/708; 101/486; 250/356

[58] Field of Search ..... 400/583, 583.3, 400/708, 708.1, 621; 101/485, 486, 248; 250/548, 536

[56] References Cited

U.S. PATENT DOCUMENTS

| | | | |
|---|---|---|---|
| 4,488,808 | 12/1984 | Kato | 250/556 |
| 4,531,851 | 7/1985 | Kondo et al. | 400/708 |
| 4,591,871 | 5/1986 | Ohta | 400/708 |
| 4,921,223 | 8/1990 | Wales et al. | 101/248 |
| 5,076,163 | 12/1991 | Sainio | 101/486 |
| 5,087,925 | 2/1992 | No et al. | 400/708 |
| 5,272,980 | 12/1993 | Takeuchi et al. | 101/485 |
| 5,313,886 | 5/1994 | Müller | 101/486 |
| 5,336,003 | 8/1994 | Nagashima et al. | 250/548 |
| 5,346,322 | 9/1994 | Okamori | 400/621 |
| 5,383,731 | 1/1995 | Hattori et al. | 400/708 |

*Primary Examiner*—Eugene H. Eickholt
*Attorney, Agent, or Firm*—Merchant, Gould, Smith, Edell, Welter & Schmidt

[57] ABSTRACT

A tape is controlled in a printing machine by advancing a length of tape through a light pathway. Transmittance of the light through the tape is measured and values are stored associated with transmittances through the tape. The tape is advanced to a start position where measured transmittance of the tape at the start position corresponds with a stored value of a measured transmittance.

5 Claims, 11 Drawing Sheets

TAPE PRINTING MACHINE WITH IR SENSING

I. CROSS REFERENCE TO RELATED APPLICATIONS

The present application discloses in claimed subject matter which is disclosed in commonly assigned and copending U.S. patent application Ser. Nos. 08/259,666, 08/259,660, now abandoned, and 08/259,661, entitled "Tape Cassette With Internal Wave Guides", "Portable Printing Machine", and "Liquid Cooled Thermal Print Head", respectively, filed concurrently herewith.

II. BACKGROUND OF THE INVENTION

1. Field of the Invention

This invention pertains to printing machines. More particularly, this invention pertains to a printing machine having infrared sensing to control positioning of a tape.

2. Description of the Prior Art

An example of a printing machine is shown in commonly assigned U.S. Pat. No. 4,815,871 dated Mar. 28, 1989. Such printing machines include a tape and a ribbon contained within a removable cassette. The cassette is mounted to the machine. Internal circuitry within the machine advances the tape past a printing head.

In the machine of the '871 patent, the printing head is a thermal printing head having a plurality of individually activated locations referred to as "pixels". The pixels oppose a drive roller or platen. The ribbon and the tape are positioned between the pixels and the drive roller in face-to-face abutting relation.

The drive roller advances both the tape and the ribbon in steps of discrete lengths of travel. After each step there is a pause during which the pixels are energized to heat causing transfer of ink from the ribbon to the tape, corresponding with the energized pixel locations. After such transfer of ink, the tape and ribbon are again incrementally advanced and the same or different pixels are energized to cause an additional transfer of ink. After successive advancement of the tape and the ribbon and successive energization of different pixels, a complete image (for example, a letter of the alphabet) is formed on the tape. In this manner, an entire message is printed.

The machine includes a keyboard which permits an operator to input information regarding the message to be printed. Also, such machines may have jack locations for permitting direct connection of the machine to a personal computer or other device such that information on the message to be printed is transferred directly from the personal computer to the circuitry of the printing machine, which then controls operation of the tape drive and print head.

The individual cassettes used in the printing machine may contain circuitry which permits identifying characteristics regarding the cassette and its contents to be interfaced with the circuitry of the print machine. For example, a tape cassette of the prior art may contain a resistor or other circuit element. The particular electronic characteristics of the element are selected to correspond with the tape contained within the cassette. By way of example, a resistor of a predetermined ohms may indicate that the cassette is carrying a white tape for receiving a black image.

Cassettes with identifying information have become progressively more sophisticated. An example of a more sophisticated cassette is shown in U.S. Pat. No. 5,318,370. In that patent, a tape cassette is shown which includes a memory circuit component which may contain a wide variety of information regarding the cassette. For example, the memory component may contain in its memory such information as the size, type, burn time, length and color of the tape contained by the cassette. Further, as illustrated in that patent, when the cassette is attached to the printing machine, the memory circuit component interfaces with the circuitry of the printing machine in an interactive manner. For example, as tape is advanced from the cassette, the printing machine can read into the memory circuit component the remaining length of tape on the cassette.

Frequently, printing machines are used to print images on a die-cut label contained on a tape. In a die-cut label tape, individual labels are separately positioned on a liner with the labels being spaced apart by fixed spacing on the liner. To insure accurate positioning of a desired message on a label, the tape must be in accurate alignment (i.e., in registration) with the thermal print head.

Prior art printing machines utilized light in the form of infrared energy to insure consistent registration. The printing machine of the prior art used both an infrared transmitter and an infrared receiver. The infrared beam generated by the transmitter was directed through the tape supply as it was advanced through a tape path. The amount of infrared energy passed through the tape was detected and measured by the infrared receiver. Less energy passing through the tape indicated that the beam was being directed through a layer of the tape containing both the liner and label material. High energy transmission through the tape indicated that the beam was passing through a liner layer not having a label layer. In this manner, infrared systems detect changes in the IR transmission levels and determine transitions from liner only to liner/label positions.

Infrared transmitters can vary from machine to machine. Also, the amount of infrared energy emitted from a transmitter can vary over time as the transmitter becomes dirty. In addition, there are variations in receiving sensor values which can change significantly from machine to machine. In view of these factors, a problem existed in keeping consistent registration while printing on die-cut labels. The prior art apparatus using infrared sensing requires that the end user of the machine make an electrical-mechanical adjustment to the transmitting infrared LED to change the amount of IR energy being admitted from the source in order to retune the sensitivity of the transmitter/receiver pair to acceptable levels. Unfortunately, user adjustment is both cumbersome and subject to error. It is an object of the present invention to provide an automatic calibration system for infrared sensing of labels.

III. SUMMARY OF THE INVENTION

According to a preferred embodiment of the present invention, a method of controlling positioning of a tape in a printing machine is disclosed. The printing machine prints an image on the tape and has means for advancing the tape past the printer. The tape includes a plurality of print fields separated by non-print areas. The print fields and the non-print areas are characterized by having measurably different transmittances. The printing machine includes a light source and a light detector separated by a light pathway. The tape is positioned to pass through the light pathway as the tape is advanced past the printer. The method of the invention includes advancing a length of the tape through the light pathway. The transmittance of the tape is measured as the length passes through the light pathway and values are stored where the values are associated with measured first and second transmittances of the tape. The tape is further advanced to a start position with a measured transmittance of the tape corresponding with a stored value of the first measured transmittance. The advance of the tape is metered from the start position and the printer is activated to print an image on a print field.

IV. BRIEF DESCRIPTION OF THE DRAWINGS

V. DESCRIPTION OF THE PREFERRED EMBODIMENT

Figure 1:
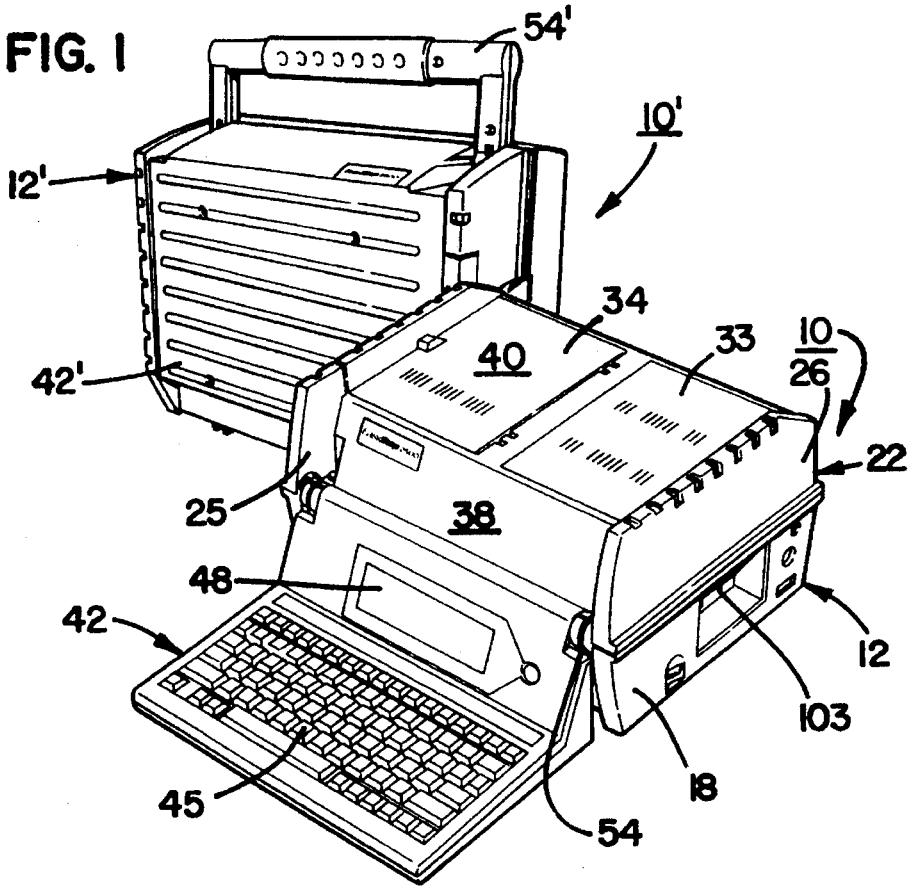
FIG. 1 is a perspective view of two printing machines according to the present invention with one shown in an open position and one shown in a closed position.
Figure 2:
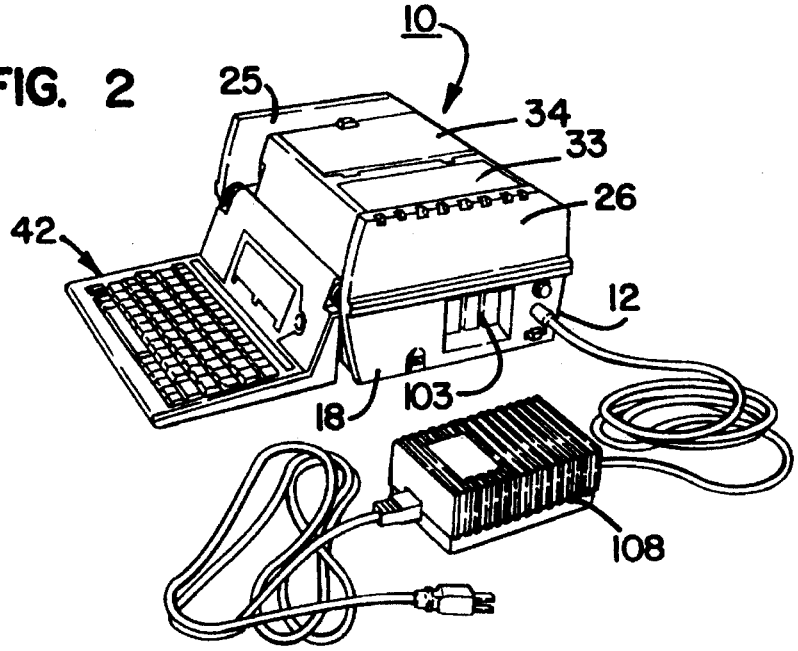
FIG. 2 shows the printing machine of the present invention secured to an AC adaptor.

With reference now to the several drawing figures in which identical elements are numbered identically throughout, a description of the preferred embodiment of the present invention will now be provided.

A. Overall Construction And Portability

With initial reference to FIGS. 1–5, the present invention is a printing machine 10 for printing labels or the like. The printing machine 10 includes a plastic housing 12 having walls defining a housing interior 14. The plastic housing 12 is generally box-like in configuration and has a flat base 16, side walls 17, 18, front wall 19 and rear wall 20.

A cover 22 is secured to the housing 12 through screws or the like. The cover 22 provides complete enclosure of interior 14. The cover 22 includes a top wall 24, side walls 25, 26, front wall 27 and rear wall 28. When secured to the housing 12, side walls 17, 25 are in generally planar alignment as are side walls 18, 26. Also, with the cover 22 secured to housing 12, front walls 19, 27 are in generally planar alignment as are rear walls 20, 28.

For purposes that will become apparent, the top wall 24 includes a first recess 30 sized to receive a tape cartridge or cassette 500 (shown in FIGS. 13–14) and a second recess 22 sized to receive a battery pack 105. A lid 34 is hinged to the top wall 24 to be pivoted between an open and closed position. In the closed position, the lid 34 completely covers the first recess 30. In the open position, the lid 34 permits a cartridge to be inserted into or removed from the first recess 30.

A latch mechanism 36 is provided for releasably securing the lid 34 in the closed position. A lid 33 and floor 35 contain the battery 109 and cover recess 32.

Side walls 17, 18 and 25, 26 extend beyond the front walls 19, 27 to define a first pocket 38 extending between the side walls. Similarly, side walls 25, 26 extend above the top wall 24 to define a second pocket 40 (see FIG. 5).

A keyboard member 42 (shown in FIGS. 1, 2, 4 and 5) is provided having a base portion 44 and an upright portion 46 extending at an angle relative to the base portion 44. For reasons that will become apparent, the base portion 44 and upright portion 46 have thicknesses substantially equal to those of recesses 38, 40, respectively.

An interior surface **46*a* of the upright portion 44 includes a liquid crystal display 48. An interior surface 44*a* of the base portion 44 contains a keyboard 45 to permit a user to input data and commands to the printing machine 10. The keyboard 42 includes an interface PC board 47 which communicates with the printing machine circuitry through a cable 43**.

An upper edge 52 of upright portion 46 is pivotably secured to the side walls 25, 26. The upright portion 46 has a width selected for the upright portion 46 to partially extend between the side walls 25, 26 within pocket 38. Similarly, the base portion 44 is sized to be substantially received between the side walls 25, 26 and be contained within the second pocket 40. As a consequence, the keyboard member 42 may be pivoted to an open position shown in FIG. 3 (and in FIG. 1 as machine 10) with the keyboard 45 accessible to an operator and with the LCD display 48 readable by an operator.

The keyboard member 42 may be pivoted from the open position to a closed position (shown as the upright machine 10' in FIG. 1). In the closed position, the upright portion 46 is received within the first pocket 38 between side walls 25, 26. The base portion 44 is received within the second pocket 40. Further, in the closed position, the keyboard member 42 and base portion 44 at least partially cover the first and second recesses 30, 32.

A handle 54 is provided to pivot about the same axis as the keyboard member 42. The handle 54 is secured to the keyboard member 42 and the housing 12. The handle 54 can be pivoted to be received within the first pocket 38 between the side walls 17, 18.

With the construction thus described, the printing machine 10 is shown as being a portable unit. In storage or in transportation, the keyboard member 42 is pivoted to the closed position and a user may grasp the handle 54 to transport the machine 10. With the keyboard member 42 in the closed position, the keyboard 45 and LCD display 48 are protected from damage. Further, the keyboard member 42 covers the first and second recesses 30, 32. To use the apparatus, an operator simply pivots the keyboard member 42 to its open position permitting access to recesses 30, 32 as well as permitting viewing of the LCD display 48 and use of the keyboard 45.

B. Circuit Components

The interior 14 of the housing 12 contains circuitry and mechanics for advancing a tape 501 and a ribbon 504 (see FIG. 13) through the machine and for printing an image on a tape. With reference to FIGS. 3, 6, 8 and 9, the interior 14 includes a tape drive subassembly 56. The tape drive subassembly 56 includes a base 58 secured to the housing 12.

Carried on the base 58 is a print head 60. Print head 60 will be more thoroughly described but includes a plurality of heat generating pixels 61 (see FIG. 6) which may be selectively energized. The pixels 61 are connected to the machine circuitry via a ribbon cable 63.

The pixel array 61 is secured to an aluminum heat sink 62. The aluminum heat sink 62 is connected to a pivot rod 64 which pivots about its axis in response to turning of a lock handle 66. The print head 60 is disposed with the pixels 61 facing a drive roller 68 mounted in a drive roller housing 70. The drive roller 68 is rotated by action of gearing connected to a drive motor (not shown).

A scissors cutter 74 is secured to the base 58 adjacent to the drive roller 68. The scissors cutter 74 is actuated by a motor to cut a tape 501 after the tape has passed between the drive roller 68 and the print head 60. Also mounted on the base 58 are contact springs 78 which are electrically connected to the machine circuitry. Projecting up from the base are positioning pins 80, a ribbon take-up drive 67 and a spring-biased return arm 82. It will be appreciated that tape drive subassemblies such as subassembly 56 having drive rollers, thermal print heads, locking bars and the like form no part of this invention per se and are shown and described in U.S. Pat. No. 4,815,871. However, a discussion of these elements is presented for the purpose of illustrating the present invention.

Figure 8:
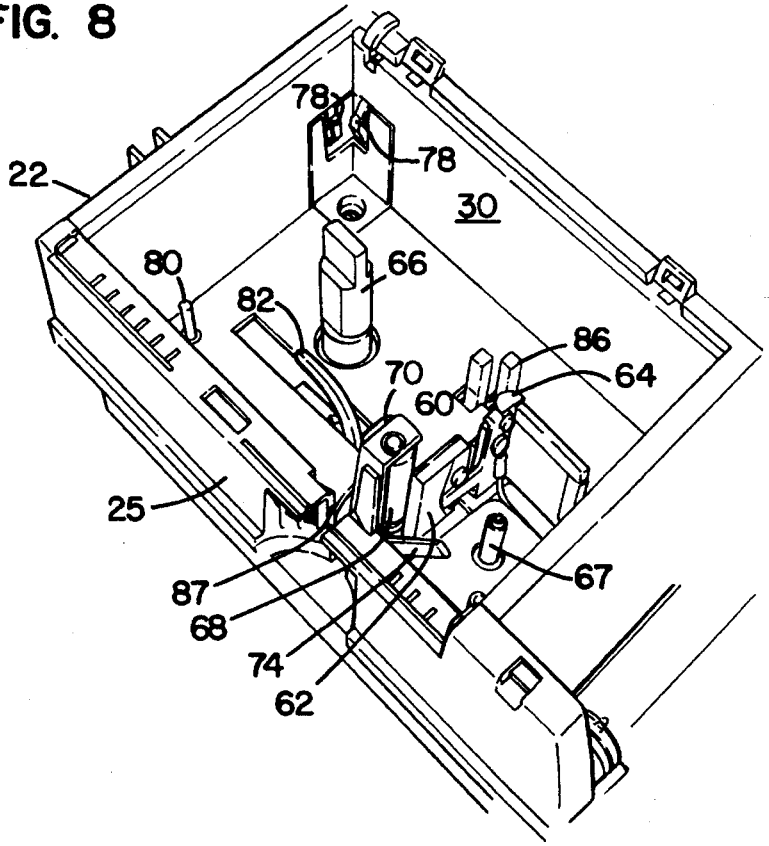
FIG. 8 is a perspective view into a cartridge receiving recess of the machine of the present invention.
Figure 9:
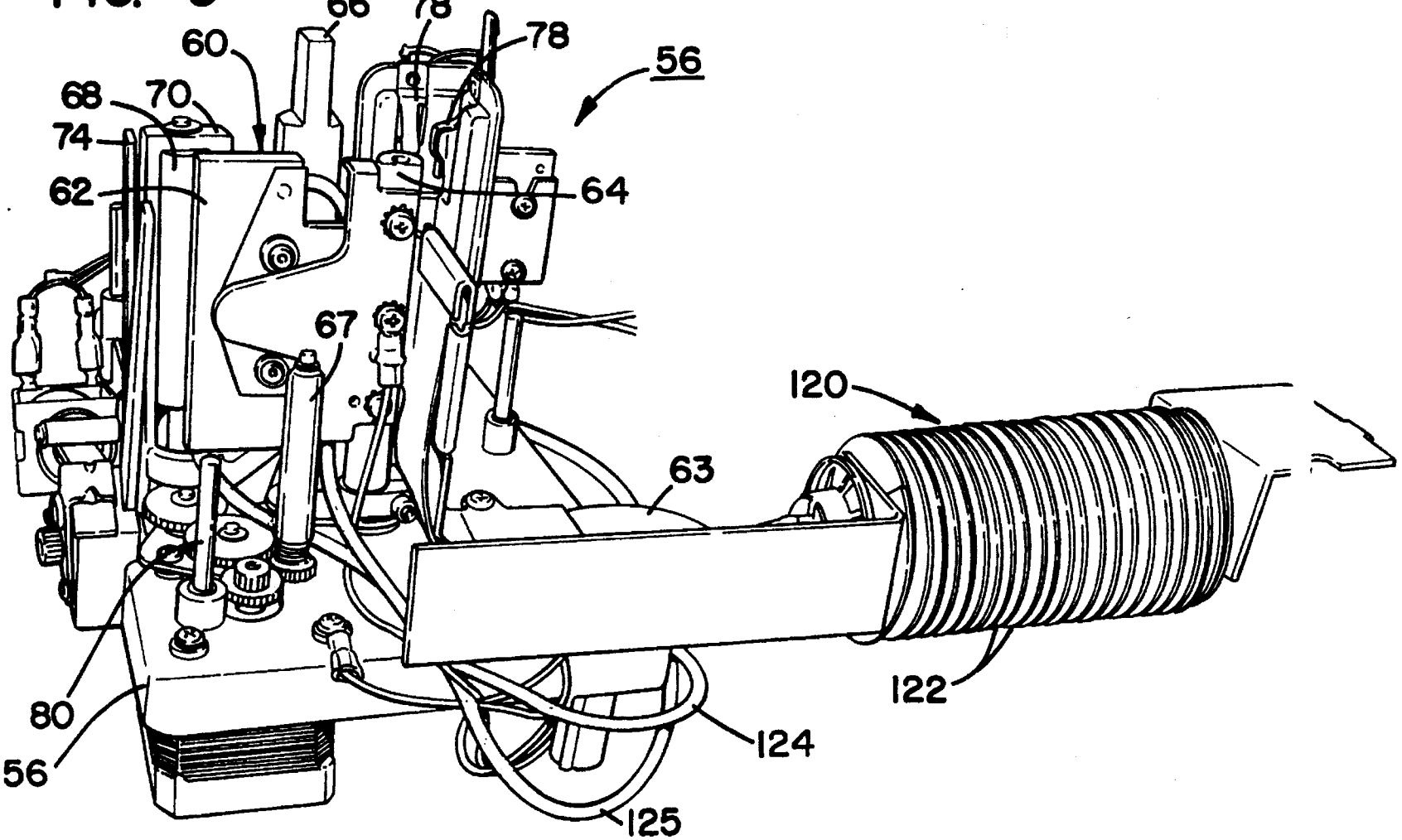
FIG. 9 is a perspective view of a drive assembly of the present invention coupled to a heat exchanger.

First and second light waveguides 84, 86 (as will be more fully discussed) project up adjacent the base portion 44. As shown in FIG. 8, the base of recess 30 has a plurality of cutouts such that when the cover 22 is secured to the housing 12, the positioning pins 80, spring contacts 78, 79, lock handle 66, return arm 82, waveguides 84, 86, scissors 74, drive roller 68, drive roller housing 70 and print head 60 all project into the first recess 30 in predetermined positions.

As will be more fully described (and as is conventional), upon placement of the tape cassette 500 within the first recess 30, an image receiving tape 501 and an image source ribbon 504 are disposed in face-to-face alignment between the drive roller 68 and the pixels 61. When the handle 66 is rotated to a locked position, the cassette 500 is locked in a predetermined alignment and the print head 60 pivots about the pivot rod 64. The pixels 61 are then urged toward and against the drive roller 68 with the tape 501 and ribbon 504 between the drive roller 68 and the pixels 61.

A ribbon take-up drive 67 also projects through into the recess 30 with the ribbon take-up drive 67 taking up excess ribbon 504 of the cassette 500.

The side wall 25 is provided with a slot 87 through which a printed tape passes after the printing operation. Also, a grounded wiper brush 89 wipes the finished tape 501 as it passes through slot 87.

Figure 3:
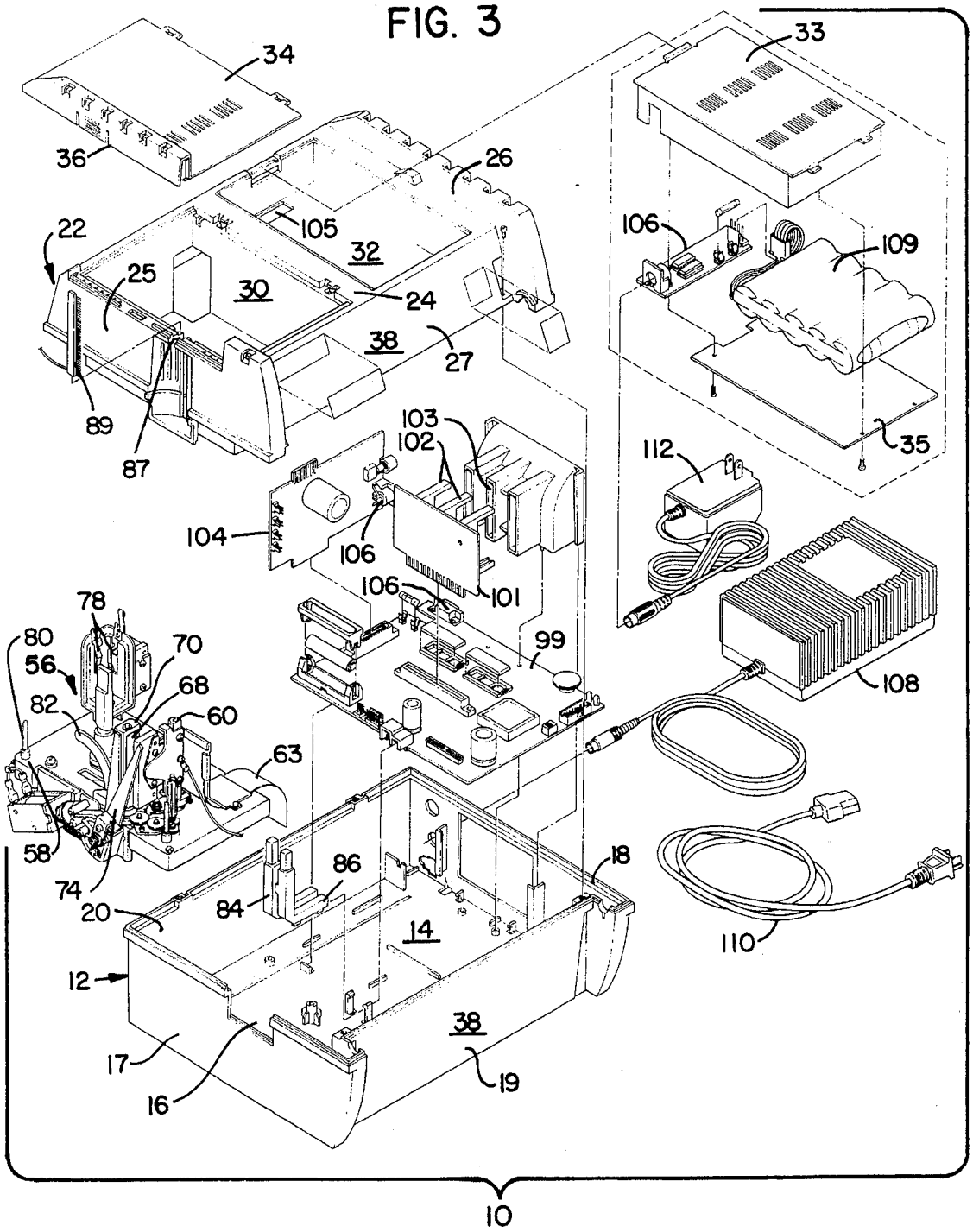
FIG. 3 is an exploded perspective view of the printing machine of the present invention without a keyboard member.
Figure 7:
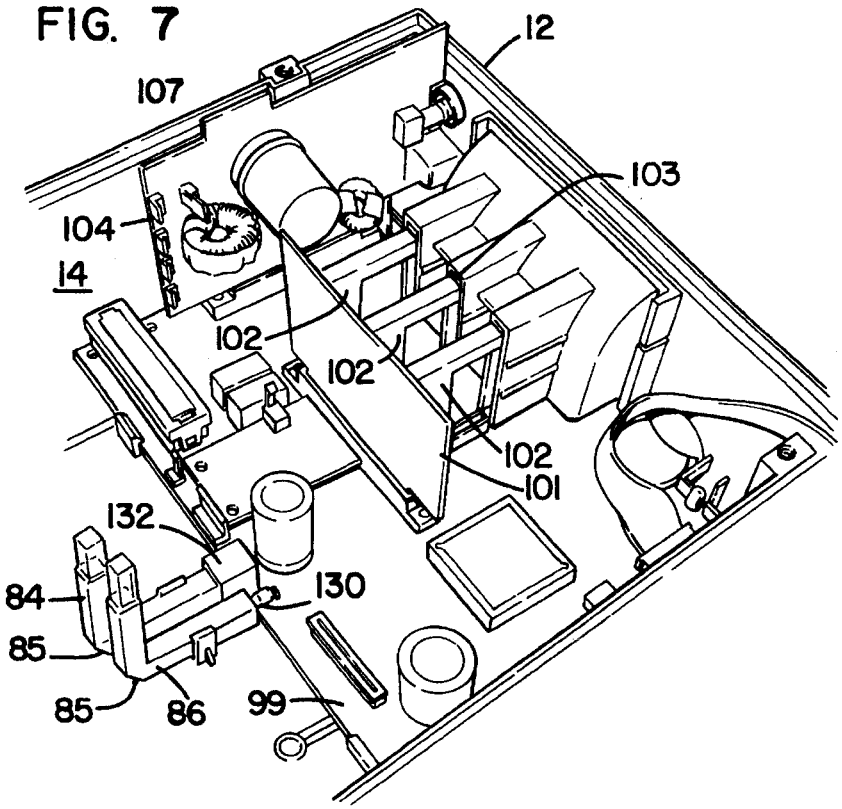
FIG. 7 is a view into a portion of the interior of the present invention.

With reference to FIGS. 3 and 7, the interior 14 of the housing 12 further includes circuitry for controlling the machine 10. Circuitry for controlling the printing machine 10 is well known and is only schematically shown and includes a mother board 99 having main printing circuitry as is conventional. The circuitry includes a font assembly 101 having a plurality of font card connectors 102 exposed through slots 103 formed in side wall 18. Each of the connectors 102 can receive a font card (not shown) which can be removed or replaced to permit the font type of the printing machine 10 to be varied at the option of a user.

Figure 12:
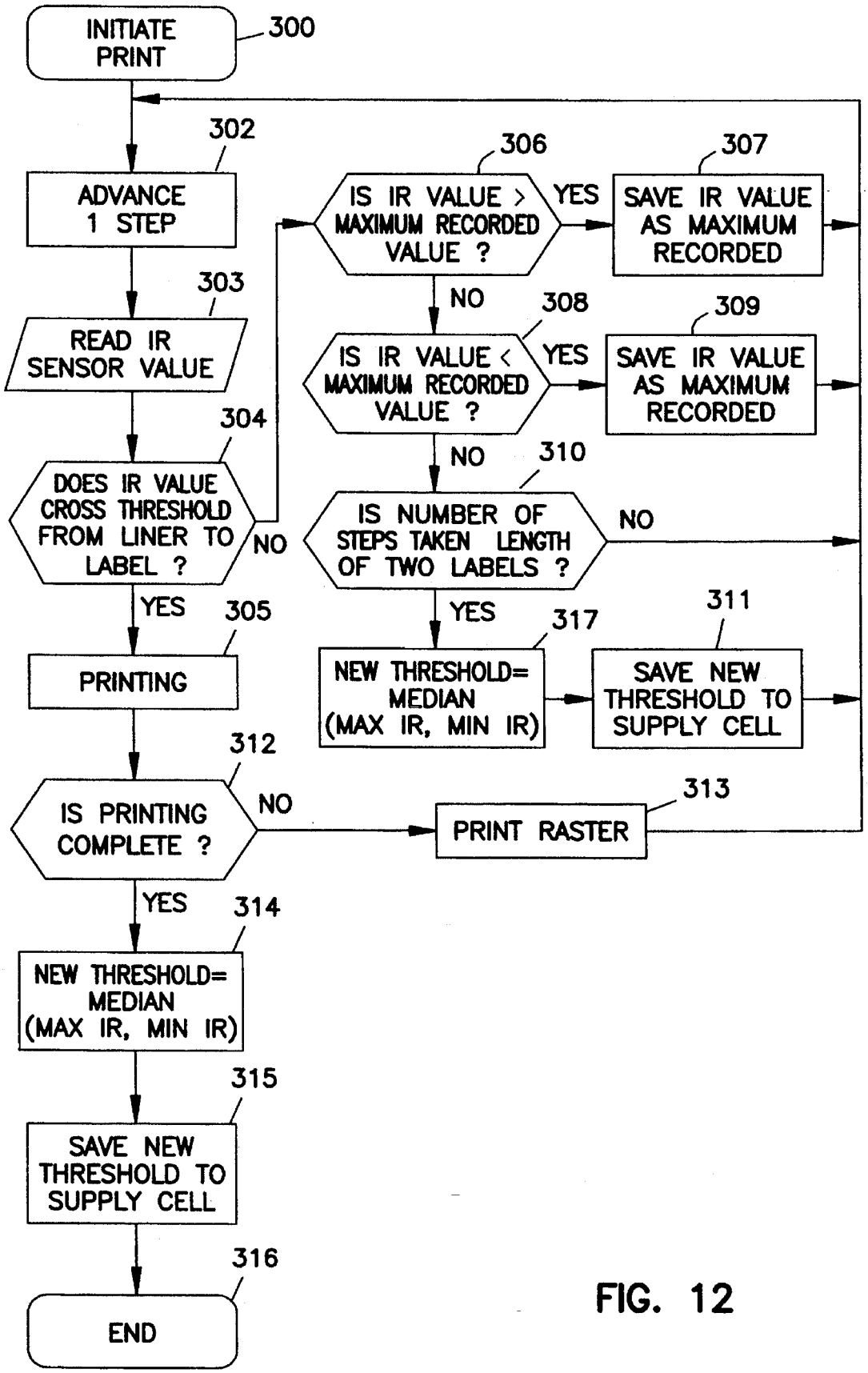
FIG. 12 is a flow chart for control of an autocalibration of the present invention.

The circuitry receives signals from the contact springs 78 off a memory circuit element 506 contained within the tape cassette 500 (FIG. 12). Such a memory circuit element 506 is shown in U.S. Pat. No. 5,318,370 and may contain such information as the size, type, burn time, length and color of the tape contained within the cassette 500. The circuitry also receives input from the keyboard 45 via a cable 43 connected to the circuitry. The circuitry controls activation of the LCD display 48 to present information to a user. Also, the circuitry controls the drive of the drive roller 68, and operation of the scissors 74.

The circuitry includes a card edge connector 104 having a connector edge 107 extending through a slot 105 formed in the second recess 32. A battery pack 109 may accordingly be placed in the recess 32 and connected to the card edge connector 104. The circuitry also includes connector ports 106 exposed through the side wall 18 to permit the circuitry to be connected directly to a personal computer via a jack 110 for receiving additional input information and control or connected to an A/C power pack 108 or the like or to receive a battery charger 112.

C. Heat Control

Figure 10:
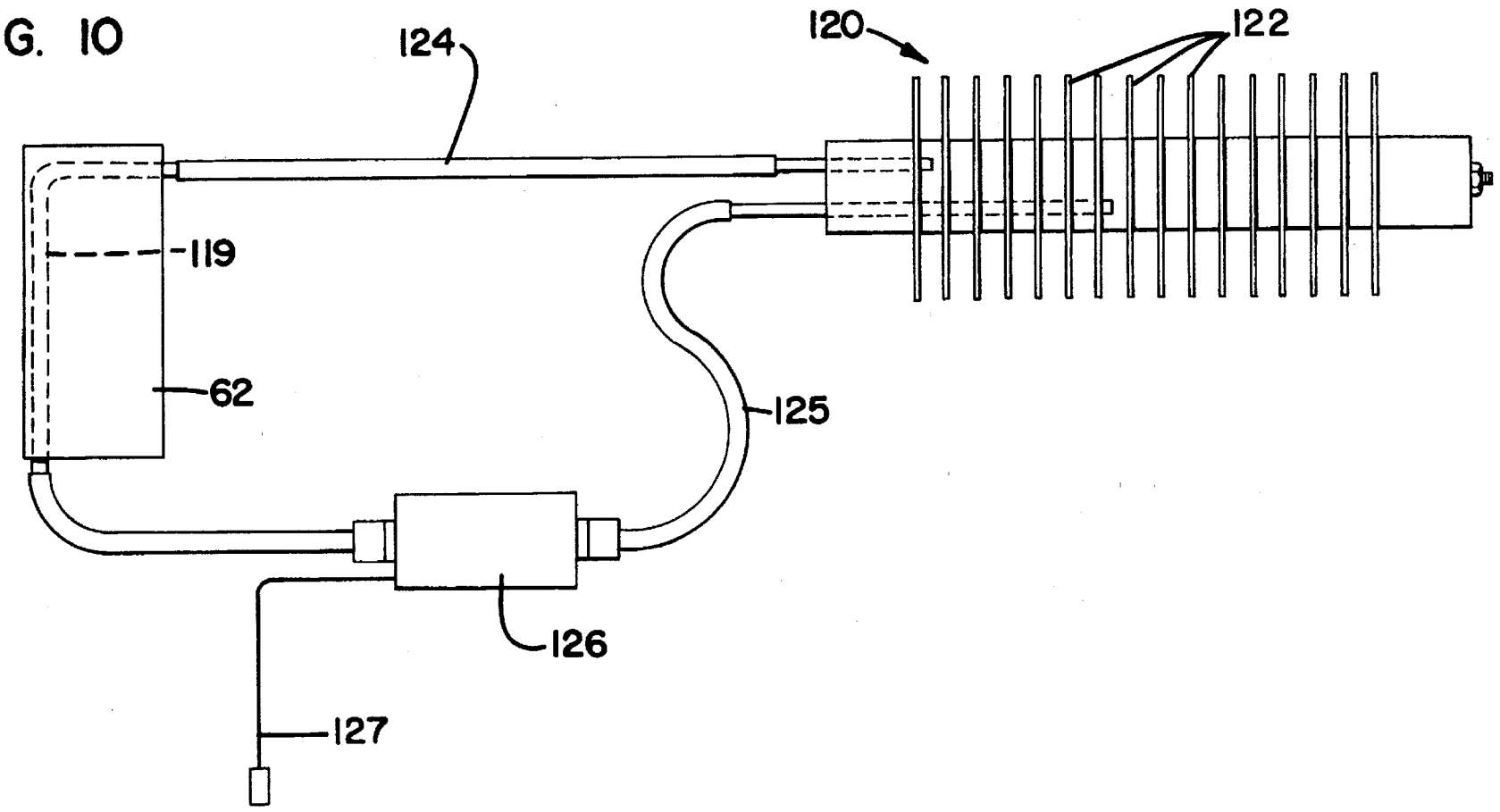
FIG. 10 is a view of the heat exchanger circuit of the present invention.

As mentioned, from time to time, the pixels 61 of print head 60 may heat up sufficiently to cause damage to a tape 501 or ribbon 504 passing between the print head 60 and the drive roller 68. To control the cooling of the print head 60, a heat sink 62 (FIGS. 9 and 10) is provided. A fluid pathway 119 is formed through the heat sink 62 and positioned behind the pixels 61. A heat transfer unit in the form of a fluid containing vessel 120 is contained within the interior 14. The vessel 120 is provided with a plurality of heat dissipating fins 122 radially extending from the vessel 120. An outlet of the vessel 120 is connected to an inlet of the fluid pathway 119 in the heat sink 62 via a conduit 124. Similarly, an output of the heat sink 62 is connected to an inlet of the heat exchanger vessel 120 through a conduit 125. Disposed within the conduit 125 is a drive pump 126 connected via a control line 127 to the machine circuitry.

In a preferred embodiment, the vessel 120 contains a liquid mixture of water and ethylene glycol which is circulated from the heat exchanger 120 through the heat sink 62 and back to the heat exchanger 120 by operation of the pump 126. As the heat sink 62 heats, excess heat is transferred to the heat exchange fluid (i.e., the ethylene glycol) with the warmed ethylene glycol returned to the vessel 120. The heat of the ethylene glycol is dissipated into the interior 14 by means of the radiating fins 122. Cooled ethylene glycol is returned to the heat sink 62 to further cool the heat sink 62 as needed.

Since cooling is not required for all printing operations, a thermocouple (not shown) is secured to the heat sink 62. Upon the thermocouple measuring a temperature of the heat sink 62 in excess of a predetermined maximum, the circuitry of the machine activates the pump 126. In the event the temperature of the heat sink 62 as measured by the thermocouple drops below a minimum temperature, the circuitry controls the pump 126 to deactivate the pump 126 and avoid unnecessary circulation of cooling fluid through the heat sink 62.

In a preferred embodiment, the thermocouple and circuitry are selected to activate the pump 126 upon the thermocouple measuring a temperature of the heat sink 62 at 40° C. The circuitry deactivates the pump 126 upon the thermocouple measuring the temperature of the heat sink at 35° C. Accordingly, excess heat is directed away from the print head heat sink 62 and the temperature of the pixel line 61 of the print head 60 can be controlled to allow heavy printing on a long-term basis without adverse side affects attributed to excessive heat (such as, damage to the tape and smearing of image on the tape).

D. IR Control

The mother board 99 (FIGS. 3 and 7) of the circuitry of the machine 10 includes a light emitting diode 130 for generating infrared light. Further, the circuitry includes a light sensitive diode 132 for generating an electrical signal to be processed by the circuitry in response to the detection of infrared light.

Each of the waveguides 84, 86 is formed of material transparent to infrared radiation. The waveguides 84, 86 are generally L-shaped with each of the waveguides having an internally reflective surface 85 at the point of bending.

Figure 4:
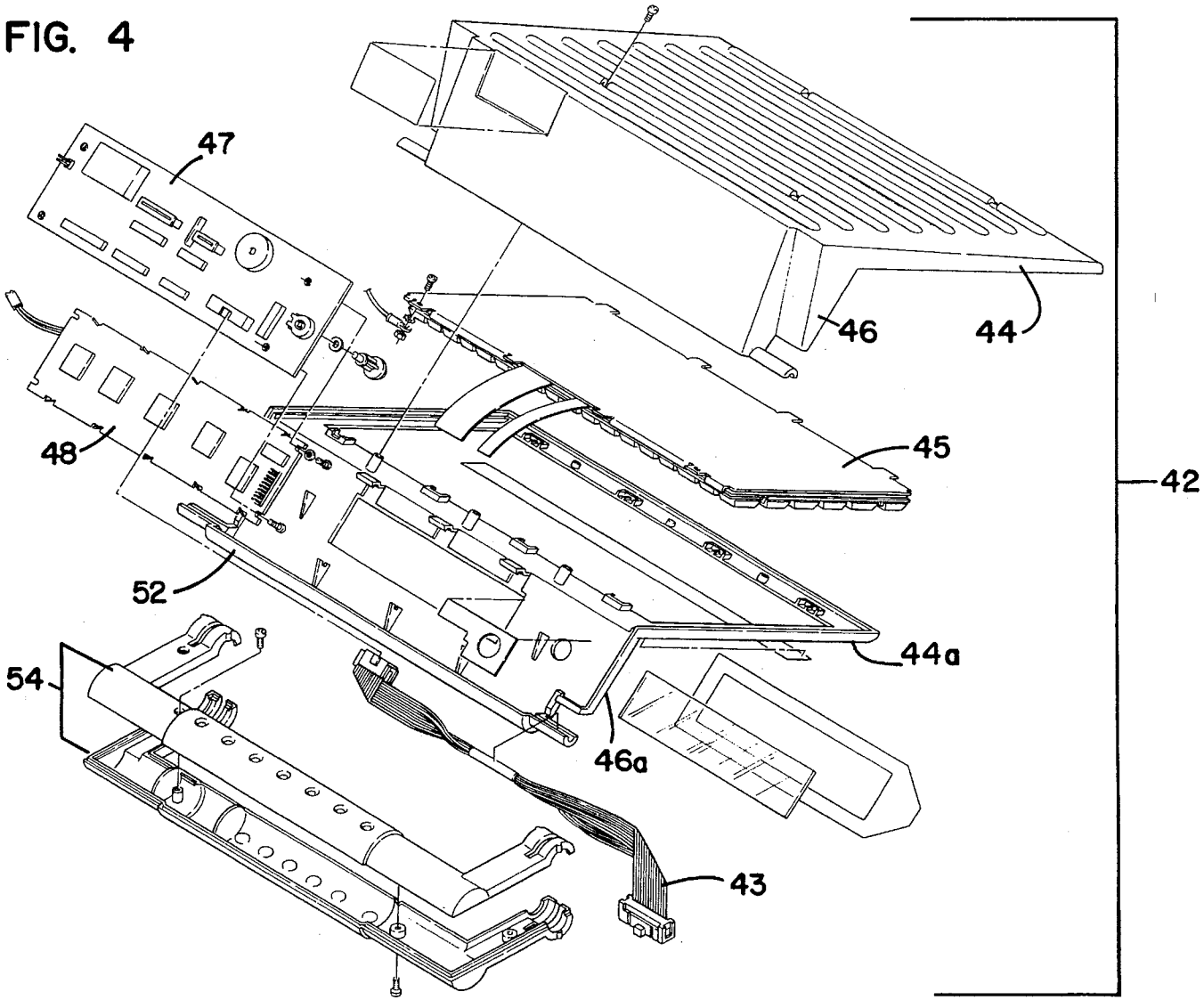
FIG. 4 is an exploded view of the keyboard member portion of the machine of the present invention.
Figure 5:
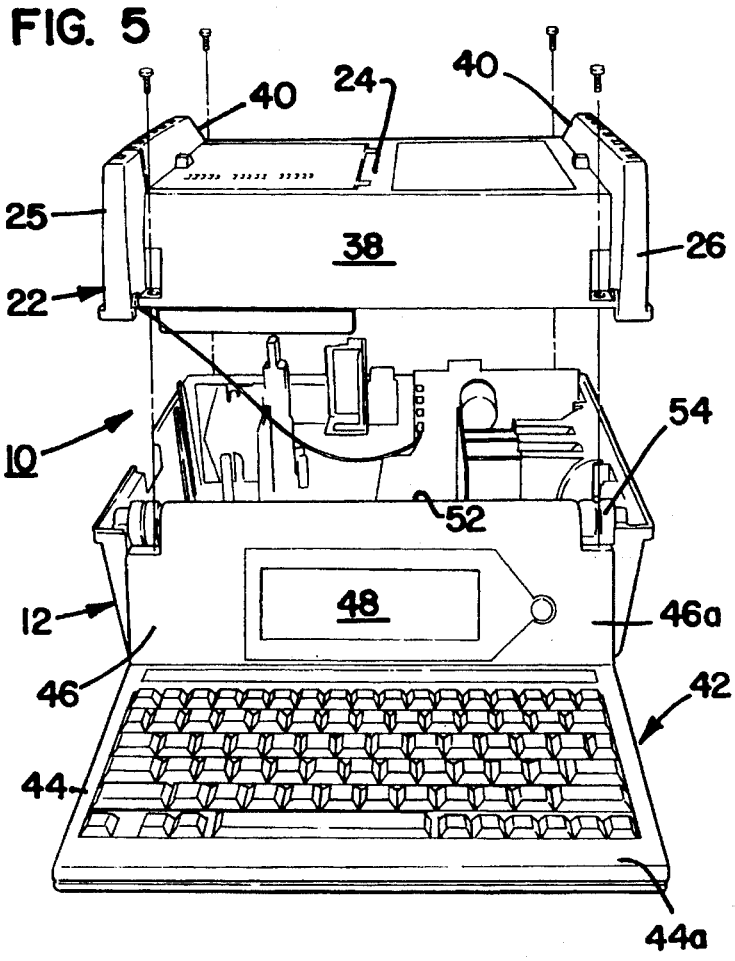
FIG. 5 is a front elevation view of a machine according to the present invention with a cover removed and with a keyboard in an open position.
Figure 6:
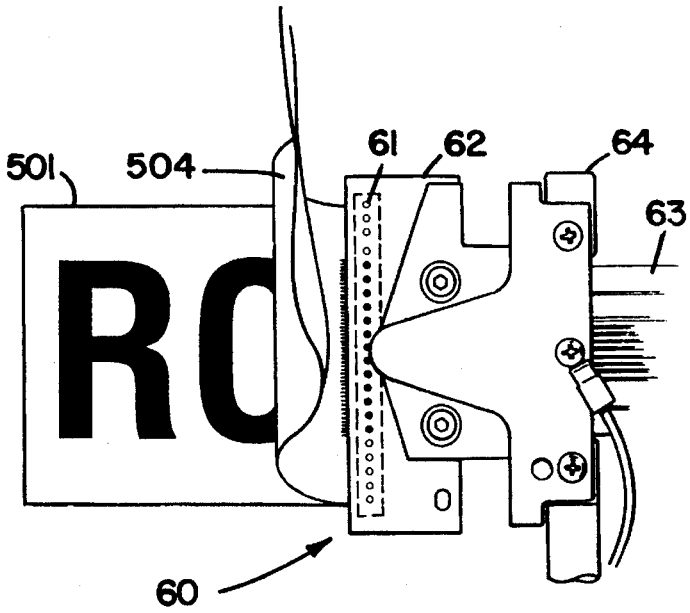
FIG. 6 is a view of a print head of the present invention opposing a tape.

The waveguides 84, 86 are positioned opposing the light emitting diode 130 and the light detecting source 132 for the waveguide 86 to direct light from the light emitting diode 130 into the recess 30 (see FIG. 4). Similarly, the second waveguide 84 is positioned to direct light from the recess 30 toward the light detector 132.

As will be more fully described, the cassette 500 includes internal waveguides including an emitter waveguide 510 and a receptor waveguide 511. The emitter waveguide 510 is positioned to receive light from the waveguide 86 and direct the light across a path to the receptor waveguide 511 which then directs the light into the second waveguide 84. Accordingly, an infrared path is provided from the light emitting diode 130 to the light receptor 132 with the path positioned to pass through a tape 501 being fed between the drive roller 68 and the pixels 61.

Figure 11:
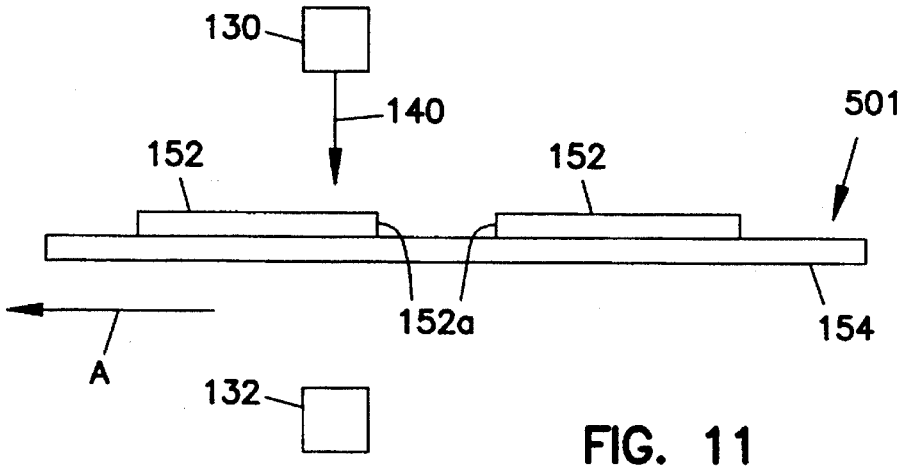
FIG. 11 is a schematic representation of a tape with a die-cut label material passed through an IR beam.

FIG. 11 schematically shows an infrared transmitter and an infrared transceiver such as the light emitting diode 130 and light receptor 132 generating an infrared beam 140 between the transmitter 130 and the receiver 132. A tape 501 is shown in a direction of travel, A, with the tape 501 passing through the IR beam 140.

In the preferred embodiment, the present invention may be utilized for printing an image on a die-cut label tape 501. In a die-cut label tape 501, a plurality of discreet labels 152 are releasably adhered to a liner 154. Each of the labels 152 is of an identical predetermined dimension and are spaced apart on the liner 154 by an identical predetermined spacing.

As the tape 501 passes through the beam 140, the amount of infrared energy that is transmitted through the tape 501 varies. For example, there is a higher transmittance of infrared energy through the tape 501 at the points on the liner 154 which are devoid of a label material 152. Where the tape 501 includes both a label 152 and a liner material 154, a reduced amount of IR energy passes through the tape 501.

Figure 11A:
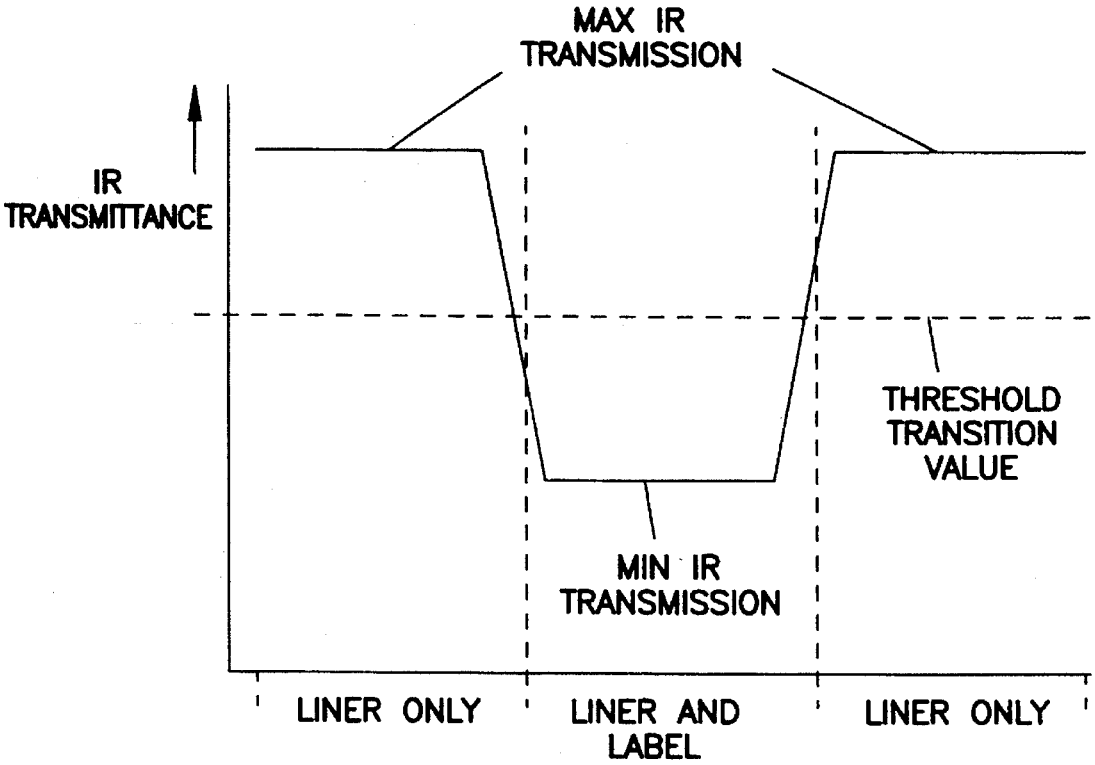
FIG. 11A is a graphical representation of infrared transmittance through a tape.

FIG. 11A is a graphic representation of the IR transmittance through the tape 501 at various locations along the tape 501. IR transmittance is a maximum (MAX IR) through liner material 154 without a label 152. At locations with both liner 154 and label 152, IR transmittance is at a minimum (MIN IR). When the edge 152*a* of a label 152 passes through beam 140, a transition or threshold value of transmittance occurs which is the median of the MAX IR and MIN IR.

As previously mentioned, prior art devices use the foregoing phenomena to control the registry of the tape 501 with respect to the print pixels. Mainly, the circuitry would receive a signal indicating the amount of IR energy that had passed through the tape 501 and use the signal to determine whether the beam was facing liner only or liner/label positions. However, such machines of the prior art were not automatically calibrated. Since IR transmitters can vary from machine to machine and since the IR receivers are subject to variation, the prior art printing machines require that the end user of the system make electrical or mechanical adjustment to the transmitting LED to change the amount of IR energy being emitted from the source.

In the present invention, the machine 10 automatically calibrates values received from the sensor 132 in order to find position information necessary to achieve label registration on the machine 10. The present invention recognizes that the actual value of the transmittance through the tape need not be determined. Instead, it is recognized that if the light beam 140 is passing through label 152 and liner 154, much of the light is blocked giving a lower sensor value than if the light beam 140 were passing through a liner material 154 only. Accordingly, if sensed values of the beam 140 are at their minimum, the present invention recognizes that the beam is passing through a label 152. If sensed values are at a maximum, the present invention recognizes that the beam is passing between labels 152 on the liner 154. When a transition from a label to a liner occurs, the amount of the transmission is an intermediate transmission (or threshold) between the maximum and minimum values. The threshold point is important. This point is referred to in the trade as "die-cut threshold" and is the position to begin printing. Accordingly, accurate and consistent detection of this point is essential.

With the present invention, the memory circuit component 506 of the cassette 500 is pre-programed at manufacture with an initial die-cut threshold value to establish the point at which the IR value detects the transition from liner only to liner/label. In the method of the present invention, when a cassette 500 is first loaded and operated, a predetermined length of the tape 501 is advanced past the print head 60. The tape 501 is advanced until the light sensor 132 determines that a threshold value has been determined. As the supply is advancing, the software reads the sensor 132 and records the measured maximum and minimum actual values of IR transmittance through the tape 501. The circuit compares the measured maximum and minimum values with the maximum and minimum values prestored in the memory circuit component 506 of the cassette 501. If the measured values correspond to the preprogrammed values, the printing operation continues without further incident with respect to the IR calibration.

If the measured threshold value does not correspond with the threshold value contained within the circuit memory component 506, automatic calibration takes place. Namely, the medium of the measured maximum and minimum values as calculated. The medium value becomes the new threshold value and is written back into the memory cell. The supply is then advanced to the new threshold value and the printing operation begins.

After each print task, the automatic calibration process thus described takes place again to obtain the most current and accurate threshold value based on the set of labels being printed. This procedure results in the most up-to-date threshold values being used. An advantage of this system includes the lack of manual adjustment of the transmitter output. Also, the automatic calibration corrects for changing conditions within the machine itself such as accumulated dirt or dust covering the transmitter 130 or sensor 132 or changing light levels due to the age of the transmitter 130. Also, the auto-calibration permits a user to quickly change die-cut label types in the machine without having the problem of manually resetting the correct light operation for that particular supply.

FIG. 12 is a schematic showing the circuit control of the auto-calibration feature of the present invention. Box 300 indicates initiation of the printing operation. Box 302 represents an incremental advance of a tape 501 past the pixels 61. In a preferred embodiment, the incremental advance will include one step of a stepper motor which corresponds to about 1/200th of an inch linear advancement of a tape 501 past the pixels 61.

Box 303 indicates reading the value of IR transmission sensed by sensor 132. Box 304 represents a decision tree for the software of the circuitry to determine if the sensed value exceeds the threshold or transition value initially stored in the circuit memory component 506 of the cassette 500. If the sensed IR value indicates that the threshold value has been crossed, the print operation begins at box 305.

In the event that the sensed IR value has not crossed the memory threshold value, box 306 indicates a decision to determine if the sensed IR value exceeds the maximum IR value currently stored in the memory circuit component 506 of the cassette 500. In the event the sensed IR value is greater than the stored maximum value, the software in box 307 stores the sensed IR value in the cassette memory circuit component 506 as the new maximum recorded value and steps 302–304 are repeated.

In the event the sensed IR value is not greater than the maximum recorded value, box 308 represents a decision tree where the sensed IR value is compared to the minimum IR value currently stored in the memory circuit component 506 of the cassette 500. In the event the sensed IR value is less than the minimum recorded value, box 309 represents a software step for saving the sensed IR value as the new minimum recorded value in the memory circuit component 506 of the cassette 500 and then, steps 302–304 are repeated.

In the event the sensed IR value is not greater than the maximum recorded value and not less than the minimum recorded value, box 310 represents a decision tree if the number of steps of advancement (i.e. box 302) exceeds the predetermined length of two labels. If no, steps 302–304 are repeated. If yes, box 317 represents the calculation of a new threshold value as the median between the maximum and the minimum IR value then currently stored in the memory circuit component 506 of the cassette 500. Box 311 represents storing the new threshold level in the memory circuit component 506 of the cassette 500 and then repeating steps 302–304.

After a printing step, box 312 represents a determination if the printing is complete. If not, the pixels 61 are energized as indicated at box 313 to print at the present step and boxes 302–305 are repeated. If the printing is complete, box 314 represents calculating the new threshold as the median of the maximum and minimum IR values then contained within the memory circuit component 506 and the new threshold is stored in the memory circuit component 506 as indicated in box 315 after which point, the printing operation is completed as indicated at box 316.

E. Cassette Construction

Figure 13:
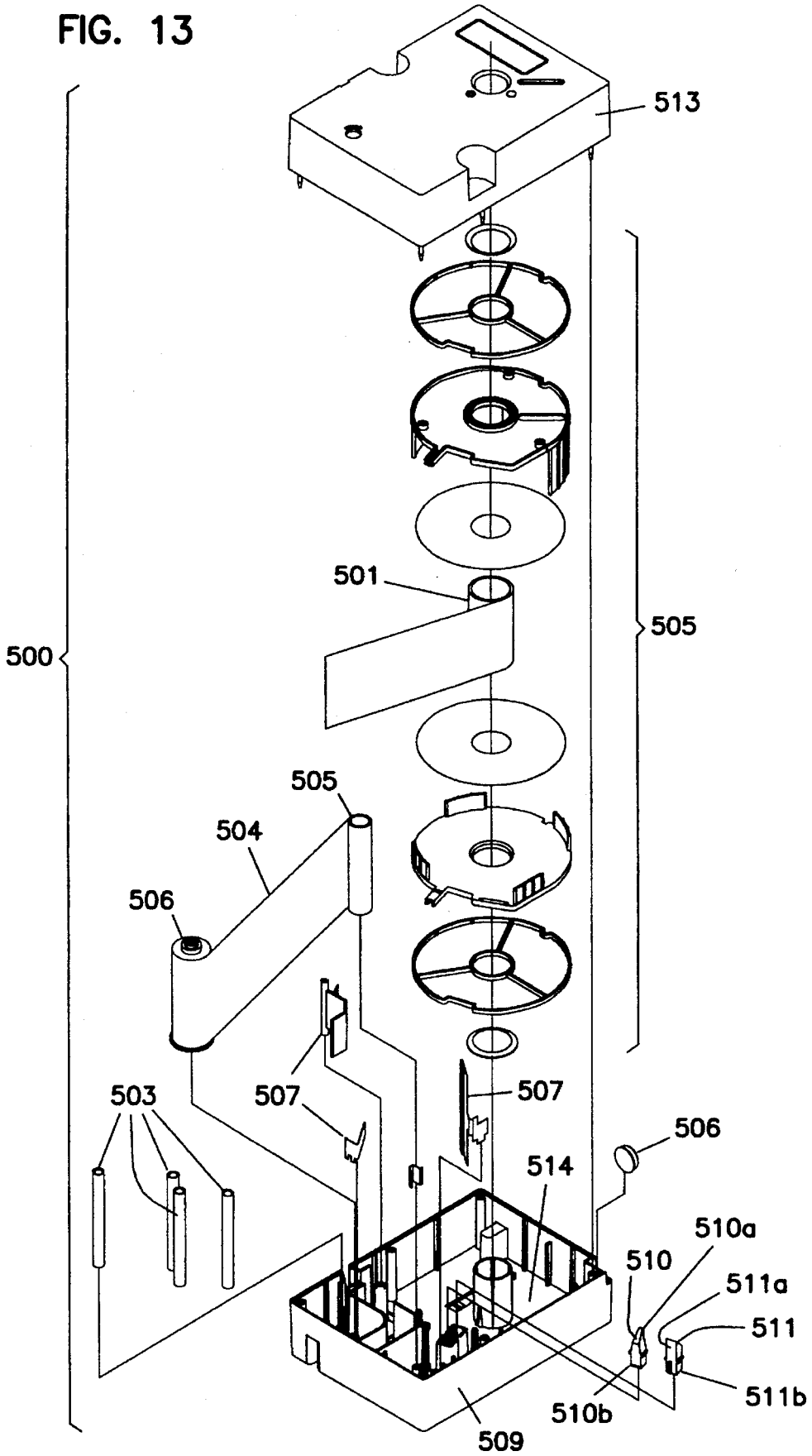
FIG. 13 is an exploded perspective view of a cassette according to the present invention.
Figure 14:
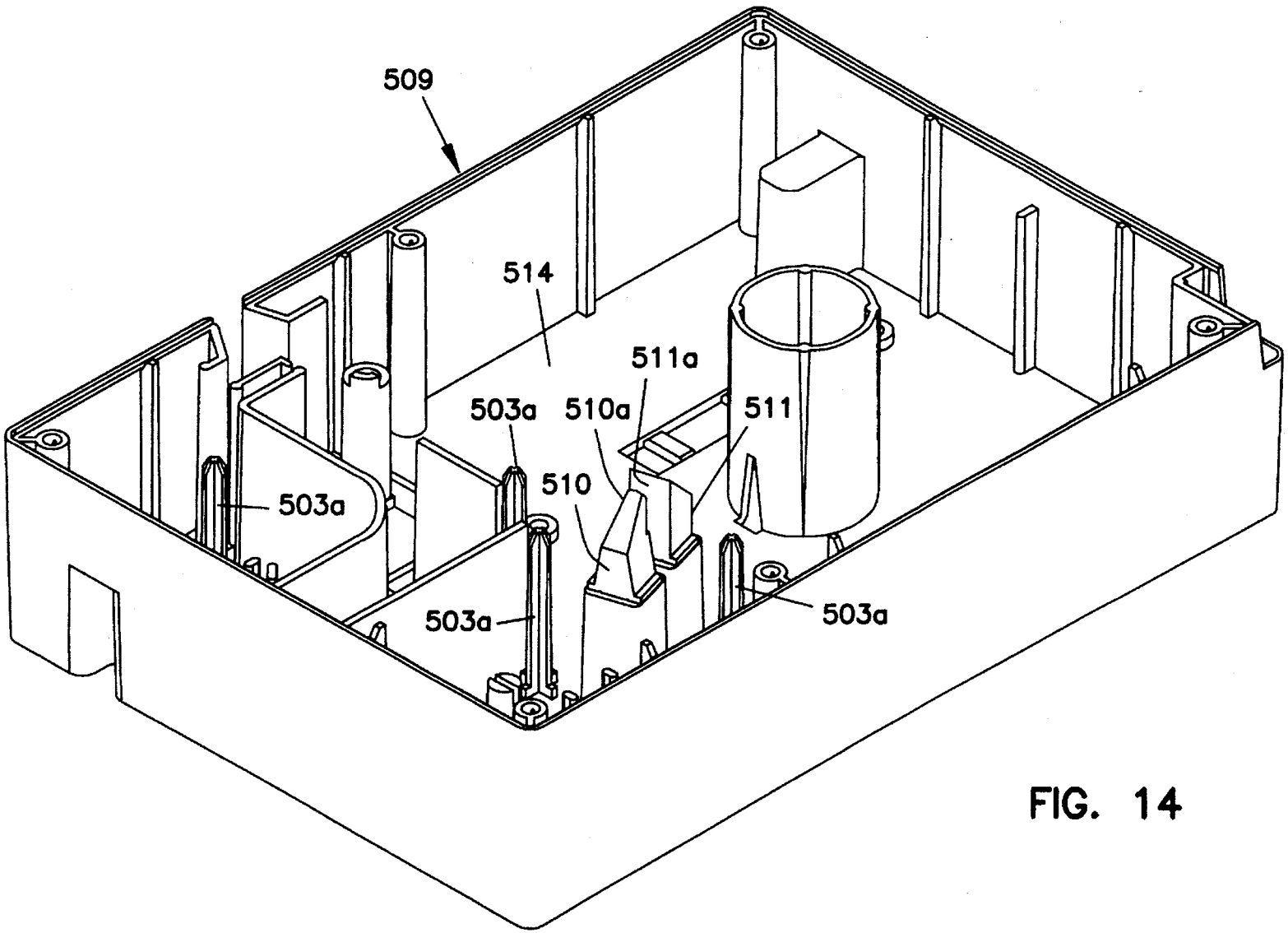
FIG. 14 is a perspective view of a housing of the cassette of FIG. 13 with waveguides in place.

The cassette 500 of the present invention is shown in FIGS. 13–14. Except for the addition of waveguides 510, 511, the construction of cassette 500 is conventional.

The cassette 500 includes a supply of a tape 501 contained on a spool 505. The tape 501 is entrained around various guide rollers 503 to pass through a tape path. The rollers 503 are rotatably placed on pins **503*a* in housing 509 (FIG. 14**).

A ribbon (or image source) 504 is contained on a source spool 505 and a take-up spool 506. The take-up spool 506 is positioned to be driven by take-up spindle 67. The cassette components are contained within a housing 509 and cover 513.

The tape 501 is positioned opposing the ribbon 504 such that the ribbon 504 and tape 501 are in face-to-face positioning between the roller 68 and the print head 60. The cassette 500 contains the memory circuit component 506 containing various indications of the cassette for operation of the machine (including the threshold IR transmittance). The cassette 500 also includes springs 507 to control tape and ribbon feed as is conventional. It will be appreciated that a cassette for placement on a print head drive assembly and having a tape and a ribbon positioned to be placed between a drive roller and a pixel head is well known. Examples of such are shown in U.S. Pat. Nos. 4,815,871 and 5,318,370 (which shows and discusses memory circuit component 506).

The present cassette further includes an emitting light waveguide 510 and a detecting light waveguide 511. The emitter 510 has an output end **510*a* opposing an input end 511*a* of the detector 511. A light beam (such as beam 140 of FIG. 11) passes from the emitter 510 to the detector 511**. The light beam is positioned to pass through the tape path.

The emitter 510 has an input end **510*b* which is flush with and exposed through the bottom 514 of the cassette housing 509. Similarly, the receptor 511 has an output end 511*b* which is flush with the cassette bottom. The emitter input 510*b* and receptor output 511*b* are positioned to oppose and optically couple with the waveguides 86, 84, respectively, when the cassette 500 is positioned within the first recess 30** in the predetermined alignment.

The opposing surfaces of the waveguides 86, 84 and the emitter 510 and the receptor 511 are polished flat and perpendicular to the longitudinal axes of the waveguides to minimize back reflection of IR light passing through the waveguides 86, 84, 510, 511. The waveguides 86, 84 and emitter 510 and receptor 511 are also provided with angled reflective surfaces to direct light from the input end **510*b* of the emitter 510 through its output end 510*a* and into the input end 511*a* of the receptor 511 and out of the output end 511*b* of the receptor 511**.

With the foregoing, infrared tracking can be provided without the need for infrared elements projecting from the drive sub-assembly and being inserted into the cassette 500 upon loading of the cassette. Instead, the cassette 500 carries its own waveguides 510, 511 which are optically coupled with the waveguides 84, 86 of the machine 10 upon loading of the cassette 500. This avoids interference of moving waveguides relative to the tape and ribbon upon loading the cassette. Such relative movement can result in either damage to the waveguides or damage to the tape and ribbon. Such potential for damage is avoided with the present invention.

From the foregoing detailed description of the preferred embodiment and it has been shown how the objects of the invention have been obtained in a preferred manner. For example, it has been shown how a portable tape printing machine is provided with automatic calibration by infrared sensing, liquid cooling of pixels and a cassette having internal waveguides carried within the cassette. While the foregoing disclosure presents the inventions in a preferred embodiment, it will be appreciated that modifications and equivalents of the disclosed concepts may readily occur to one skilled in the art having the benefits of the teachings of the present disclosure. Accordingly, it is the intent of the inventors that the present invention not be limited to the specific embodiment disclosed, but shall include such modifications and equivalents as may readily occur to one skilled in the art.

What is claimed:

1. A method of controlling positioning of a tape in a printing machine having a printer for printing an image on said tape and means for advancing said tape past said printer, said tape including a plurality of print fields separated by non-print areas, said print fields and said non-print areas characterized by measurably different transmittances, said print machine including a light source and a light detector separated by a light pathway at a predetermined distance from said printer, said tape positioned to pass through said light pathway as said tape is advanced past said printer, said method comprising:

advancing a length of said tape through said light pathway;

measuring a transmittance of said tape as said length passes through said light pathway and storing values associated with measured first and second transmittances of said tape;

further advancing said tape to a start position with a measured transmittance of said tape at said start position corresponding with a stored value of said first measured transmittance;

metering advancement of said tape from said start position and activating said printer to print an image on at least one of said print fields.

2. A method according to claim 1 wherein said non-print areas and said print fields are of predetermined dimensions and spacing, wherein said further advancement includes advancing said tape a distance corresponding to at least one of said predetermined dimensions and subsequently adjusting a position of said tape to said start position by adjusting said position until a measured transmittance of said tape corresponds with a stored value of said first measured transmittance.

3. A method according to claim 1 wherein said print field, and said non-print areas are characterized by measurably different high and low transmittances, respectively, said measuring comprises storing values associated with measured high and low transmittances of said tape and said further advancing comprises advancing said tape to said start position with said measured transmittances corresponding with a stored value of at least one of said measured high and low transmittances.

4. A method according to claim 3 wherein said tape includes an intermediate area of intermediate transmittance.

5. A method according to claim 1 comprising initially storing presumed values corresponding to said first and second transmittances and replacing said presumed values with said values associated with said measured first and second transmittances.

* * * * *